US007546806B1

(12) United States Patent
Daniels et al.

(10) Patent No.: US 7,546,806 B1
(45) Date of Patent: Jun. 16, 2009

(54) SELECTABLE OUTPUT WELL PERFORATOR AND METHOD FOR PRODUCING VARIABLE HOLE PROFILES

(75) Inventors: Arthur S. Daniels, Rockaway, NJ (US); Ernest L. Baker, Wantage, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 450 days.

(21) Appl. No.: 11/277,425

(22) Filed: Mar. 24, 2006

(51) Int. Cl.
*F42B 1/00* (2006.01)

(52) U.S. Cl. ..... 102/306; 102/476; 89/1.15

(58) Field of Classification Search ..... 102/306, 102/307, 308, 310, 476, 309; 89/1.15
See application file for complete search history.

(56) References Cited

U.S. PATENT DOCUMENTS 2,763,210 A * 9/1956 Church et al. ..... 102/307
3,443,518 A * 5/1969 Cross ..... 102/306
3,855,929 A * 12/1974 Ridgeway ..... 102/331
4,784,062 A * 11/1988 Rudolf et al. ..... 102/476
4,860,655 A * 8/1989 Chawla ..... 102/306
4,862,804 A * 9/1989 Chawla et al. ..... 102/309
4,982,667 A * 1/1991 Weimann ..... 102/476
5,229,542 A * 7/1993 Bryan et al. ..... 102/491
5,479,860 A * 1/1996 Ellis ..... 102/313
5,792,977 A * 8/1998 Chawla ..... 102/307
5,939,663 A * 8/1999 Walters et al. ..... 102/476
6,925,924 B2 * 8/2005 Baker et al. ..... 89/1.151

* cited by examiner

*Primary Examiner*—Troy Chambers
*Assistant Examiner*—Jonathan C Weber
(74) *Attorney, Agent, or Firm*—John F. Moran

(57) ABSTRACT

Various shaped charges and methods of operation produce multiple jets in various profiles by employing multiple initiation points to address various earthen formations and producing different types of perforations in well bores. The shaped charge device includes a configuration of components wherein multiple detonation tracks are used to allow selective initiation and operation. Dual or quad initiation may be provided to initiate operation.

18 Claims, 3 Drawing Sheets

SELECTABLE OUTPUT WELL PERFORATOR AND METHOD FOR PRODUCING VARIABLE HOLE PROFILES

STATEMENT OF GOVERNMENT INTEREST

The inventions described herein may be manufactured, used and licensed by or for the U.S. Government for U.S. Government purposes.

BACKGROUND OF THE INVENTION

The invention relates in general to wells and in particular to initiating flow from a well.

To initiate the flow of oil and/or other materials in a well, a conventional shaped charge warhead (or perforator) is fired through the well casing, the cement sheath and into the earthen formation. A shaped charge device comprises a shaped charge liner backed by high explosives. When the explosives are detonated, the shaped charge device forms a high velocity forward moving penetrator or "jet" that is capable of deeply penetrating the targeted material.

Output of a well is dependent on several factors including the size of the hole made by the perforator, the hole shape and the penetration depth. Fracturing fluids are pumped into the hole to fracture the rock formation and special agents in the fluid hold the fractures open to allow flow. Small diameter holes (as produced by conventional shaped charges) have a tendency to clog with these agents. Well and rock conditions vary at different depths in the same well and in different wells, due to geological differences.

A variety of perforators are available for different applications. A disadvantage of conventional perforators is they can only produce one jet profile per design. A single perforator lacks the ability to handle varying well and rock conditions. Most available perforators are designed to produce deep penetration but with a very small diameter hole. To change the jet output and, therefore, the hole profile, a different perforator is required for each desired hole profile.

At present, a variety of perforators must be on hand to handle different situations. U.S. Pat. No. 6,925,924 issued on Aug. 9, 2005 and is incorporated by reference herein. The '924 patent shows shaped charge perforators with multiple initiation points. These perforators can produce different jets. However, each perforator is limited to producing a single jet profile. Thus, a need exists for a single perforator that can selectively produce varying jet outputs for different applications.

SUMMARY OF THE INVENTION

It is an object of the invention to provide an apparatus and method for selectively producing different types of perforations in well bores.

A first aspect of the invention is a shaped charge comprising a case having an open front end, a closed rear end, an interior and a longitudinal axis; an explosive material disposed in the interior of the case; and a liner disposed over the explosive material; wherein the case includes a first channel extending from an opening on the rear end of the case along the longitudinal axis to an opening in the interior of the case adjacent the explosive material; and a pair of second channels, the pair of second channels having a common opening on the rear end of the case, the common opening being a different opening than the opening for the first channel, the pair of second channels ending in a pair of diametrically opposed openings in the interior of the case adjacent the explosive material, the pair of openings being disposed on opposite sides of the opening of the first channel.

The shaped charge may further comprise a pair of third channels, the pair of third channels having a common opening on the rear end of the case, the common opening for the third channels being a different opening than the opening for the first channel and the common opening for the second channels, the pair of third channels ending in a pair of diametrically opposed openings in the interior of the case adjacent the explosive material, the pair of openings being disposed on opposite sides of the interior case opening of the first channel and further forward than the pair of interior case openings for the second channels.

A second aspect of the invention is a method comprising providing a shaped charge according to the first aspect of the invention; and detonating the shaped charge using only one of 1) the opening on the rear end of the case for the first channel; 2) the common opening on the rear end of the case for the second channels; and 3) the common opening on the rear end of the case for the third channels.

A third aspect of the invention is a shaped charge comprising a case having an open front end, a closed rear end, an interior and a longitudinal axis; an explosive material disposed in the interior of the case; and a liner disposed over the explosive material; wherein the case includes four channels extending from a common opening on the rear end of the case to four diametrically opposed openings in the interior of the case adjacent the explosive material.

The shaped charge may further comprise a fifth channel extending from an opening on the rear end of the case to an opening in the interior of the case adjacent the explosive material, the opening on the rear end of the case being a different opening than the common opening for the four channels, the opening in the interior of the case being centered on the longitudinal axis.

A fourth aspect of the invention is a method comprising providing a shaped charge according to the third aspect of the invention; and detonating the shaped charge using only one of the common opening on the rear end of the case for the four channels and the opening on the rear end of the case for the fifth channel.

A fifth aspect of the invention is a shaped charge comprising a case having an open front end, a closed rear end, an interior and a longitudinal axis; an explosive material disposed in the interior of the case; and a liner disposed over the explosive material; wherein the case includes a first channel extending from an opening on the rear end of the case along the longitudinal axis to an interior opening in the interior of the case adjacent the explosive material; and a pair of second channels extending from a pair of openings on the rear end of the case to a pair of diametrically opposed interior openings in the interior of the case adjacent the explosive material, the pair of diametrically opposed interior openings of the second channels being disposed on opposite sides of the first channel.

The shaped charge may further comprise a pair of third channels extending from a pair of openings on the rear end of the case to a pair of diametrically opposed interior openings in the interior of the case adjacent the explosive material, the pair of diametrically opposed interior openings of the third channels being disposed on opposite sides of the interior opening of the first channel and radially outward from the pair of interior openings of the second channels.

The shaped charge may additionally comprise a pair of fourth channels extending from a pair of openings on the rear end of the case to a pair of diametrically opposed interior openings in the interior of the case adjacent the explosive material, the pair of diametrically opposed interior openings of the fourth channels being disposed on opposite sides of the interior opening of the first channel, radially outward from the pair of interior openings of the third channels and axially forward from the pair of interior openings of the third channels.

Advantageously, the shaped charge further comprises a pair of fifth channels extending from a pair of openings on the rear end of the case to a pair of diametrically opposed interior openings in the interior of the case adjacent the explosive material, the pair of interior openings for the fifth channels being disposed on opposite sides of the interior opening of the first channel, radially outward from the pair of interior openings of the fourth channels and axially forward from the pair of interior openings of the fourth channels.

In one embodiment of the fifth aspect of the invention, the shaped charge further comprises a pair of sixth channels extending from a pair of openings on the rear end of the case to a pair of diametrically opposed interior openings in the interior of the case adjacent the explosive material, the pair of interior openings of the sixth channels being disposed on opposite sides of the interior opening of the first channel, offset circumferentially about ninety degrees from the interior openings of the second pair of channels and disposed radially outward from the interior opening of the first channel about a same distance as the interior openings for the second pair of channels.

A sixth aspect of the invention is a method comprising providing the shaped charge of fifth aspect of the invention; and detonating the shaped charge using at least one of the first channel, the pair of second channels, the pair of third channels, the pair of fourth channels, the pair of fifth channels and the pair of sixth channels. The detonating step may include using only one of the first channel, the pair of second channels, the pair of third channels, the pair of fourth channels, the pair of fifth channels and the pairs of second and sixth channels.

A seventh aspect of the invention is a method comprising providing a shaped charge having a case having an open front end, a closed rear end, an interior and a longitudinal axis; an explosive material disposed in the interior of the case; and a liner disposed over the explosive material; the shaped charge including a plurality of channels formed therein extending from the rear end to the interior adjacent the explosive material; and detonating the shaped charge using at least one, but not all, of the plurality of channels.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Shaped charges that produce a long and narrow jet by axial initiation will produce a fan-like jet if two diametrically opposed detonators are initiated along the side of the warhead. As the detonation points are moved forward along the warhead, the jet output changes. Single point initiation produces a long thin jet for deep penetration. Moving multiple detonation points slightly forward produces a narrow fan-shaped jet followed by a foreshortened round jet. Moving the detonation points even further forward produces a wide fan-shaped jet.

The use of four detonation points can produce a variety of effects depending on initiation locations. These locations usually involve a tradeoff between hole depth and hole cross-sectional area. The present invention is a selectable output, shaped charge perforator that can produce various jet profiles. Thus, one perforator may be used to produce jet patterns that can vary depending on well and rock conditions. Multiple sets of dual diametrically-opposed detonation points (or quad detonation points) are included in the shaped charge case to allow for selection of the required jet profile to match required conditions.

Commercial well perforators generally use detonation cord (det cord) as the initiation mechanism. In the invention, multiple detonation tracks are fabricated in the shaped charge case to allow selective initiation by choice of det cord placement, or, by rotating or indexing the perforator in its holding fixture. Dual (two point) or quad (four point) initiation may be accomplished from a common point or from multiple points.

Figure 1A:
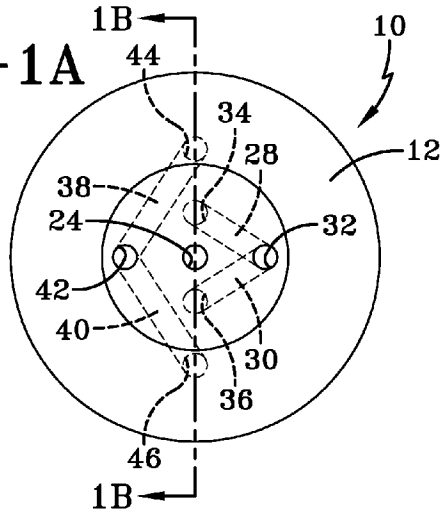
FIG. 1A is a rear view of one embodiment of a shaped charge.
Figure 1B:
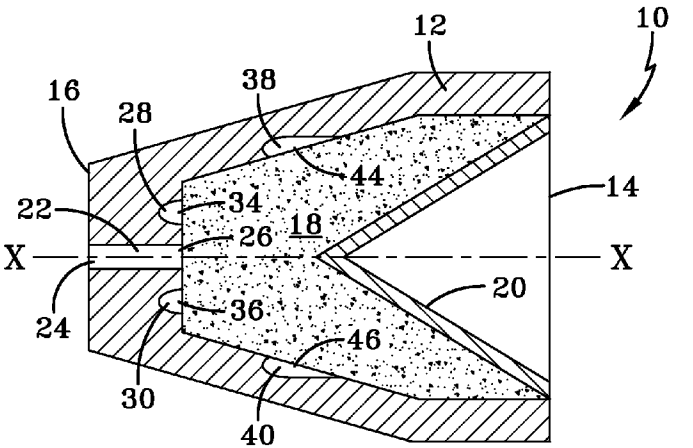
FIG. 1B is a sectional view along the line 1B-1B of FIG. 1A.
Figure 1D:
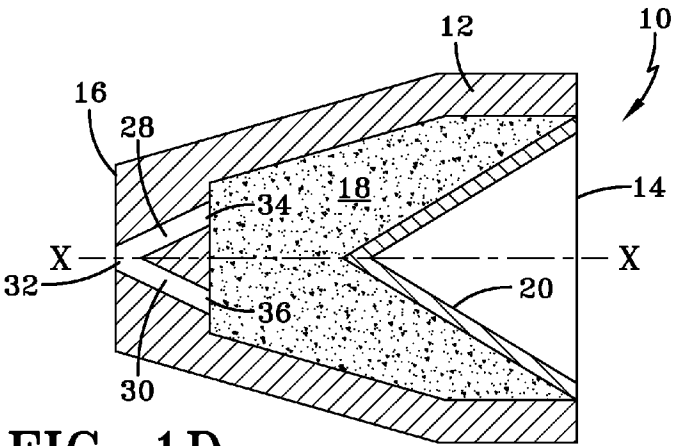
FIGS. 1C and 1D are modified sectional views of FIG. 1A.
Figure 1C:
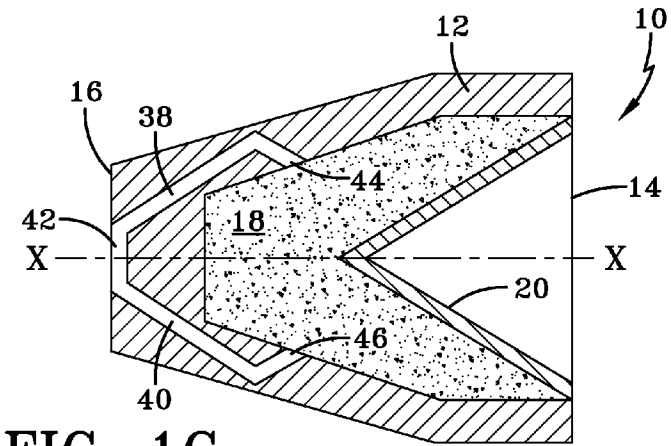

FIG. 1A is a rear view of one embodiment of a shaped charge 10. FIG. 1B is a sectional view along the line 1B-1B of FIG. 1A. Shaped charge 10 includes a case 12 having an open front end 14, a closed rear end 16, an interior and a longitudinal axis X-X. An explosive material 18 is disposed in the interior of the case 12. A liner 20 is disposed over the explosive material 18. In FIG. 1A, the dotted lines represent channels within the case 12 and openings into the interior of the case 12. FIGS. 1C and 1D are modified sectional views of FIG. 1A. In FIGS. 1C and 1D, only one pair of channels are shown. For purposes of clarity, FIGS. 1C and 1D are planar projections of the channels 38, 40 and 28, 30, respectively.

Case 12 includes a first channel 22 extending from an opening 24 on the rear end of the case along the longitudinal axis X-X to an opening 26 in the interior of the case adjacent the explosive material. A pair of second channels 28, 30 have a common opening 32 on the rear end of the case. The common opening 32 is a different opening than the opening 24 for the first channel 22. The pair of second channels 28, 30 end in a pair of diametrically opposed openings 34, 36 in the interior of the case adjacent the explosive material. The pair of openings 34, 36 are disposed on opposite sides of the opening 26 of the first channel 22. Preferably, the pair of openings 34, 36 are about a same distance from the interior case opening 26 for the first channel 22. More preferably, the pair of openings 34, 36 and the interior case opening 26 for the first channel are substantially collinear.

Shaped charge 10 further comprises a pair of third channels 38, 40. The pair of third channels 38, 40 having a common opening 42 on the rear end of the case 12. The common opening 42 for the third channels is a different opening than the opening 24 for the first channel and the common opening 32 for the second channels. The pair of third channels 38, 40 end in a pair of diametrically opposed openings 44, 46 in the interior of the case adjacent the explosive material. The pair of openings 44, 46 are disposed on opposite sides of the interior case opening 26 of the first channel and located axially further forward than the pair of interior case openings 34, 36 for the second channels 28, 30. Preferably, the pair of interior case openings 34, 36 for the third channels are about a same distance from the interior case opening 26 for the first channel. More preferably, the pair of interior case openings 34, 36 for the third channel and the interior case opening 26 for the first channel are substantially collinear.

Figure 2A:
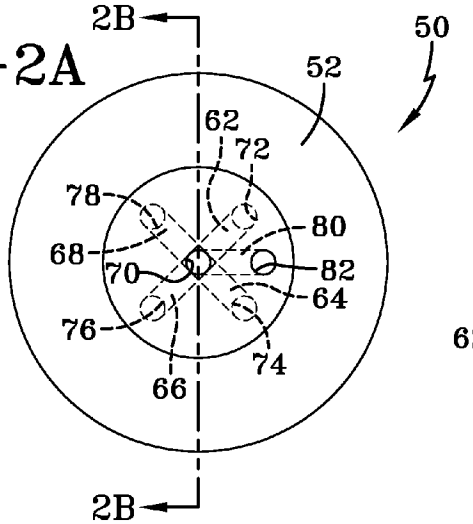
FIG. 2A is a rear view of another embodiment of a shaped charge.
Figure 2B:
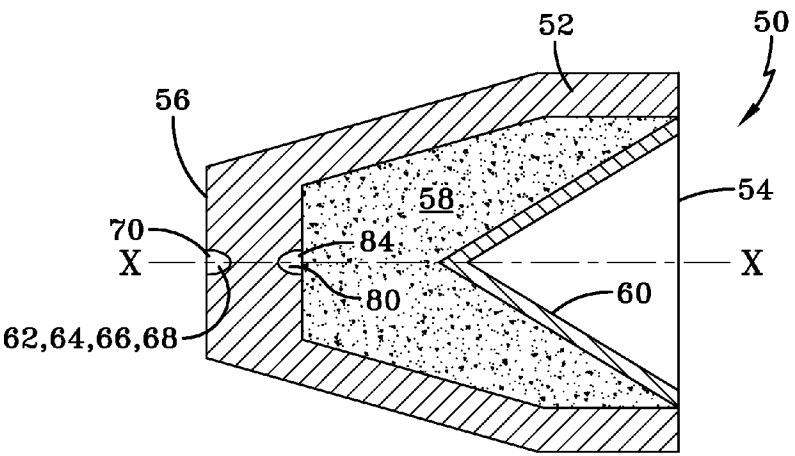
FIG. 2B is a sectional view along the line 2B-2B of FIG. 2A.
Figure 2C:
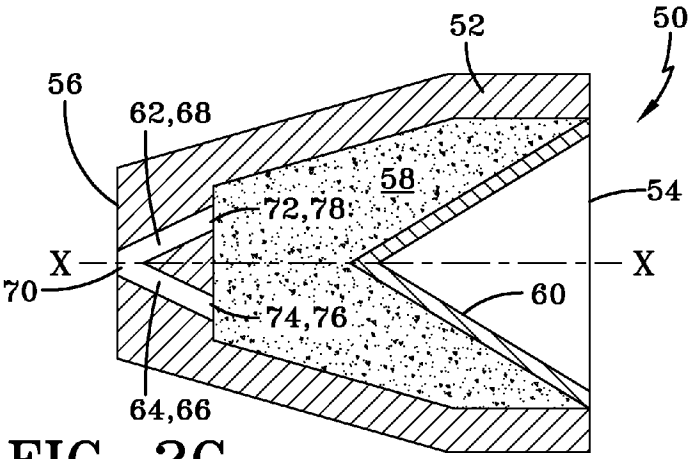
FIGS. 2C and 2D are modified sectional views of FIG. 2A.
Figure 2D:
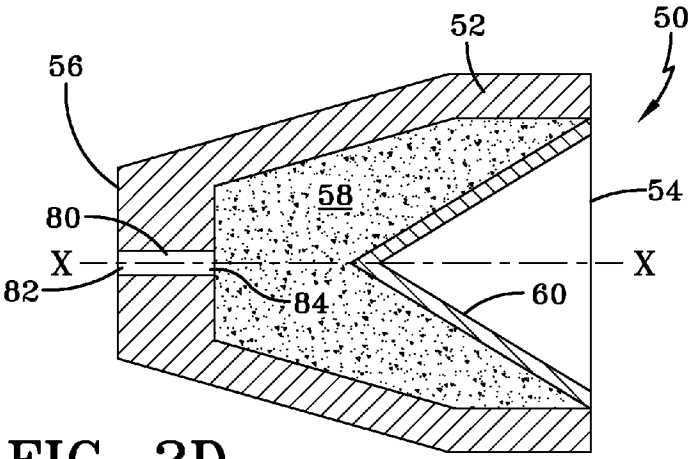

FIG. 2A is a rear view of another embodiment of a shaped charge 50. FIG. 2B is a sectional view along the line 2B-2B of FIG. 2A. Shaped charge 50 comprises a case 52 having an open front end 54, a closed rear end 56, an interior and a longitudinal axis X-X. Explosive material 58 is disposed in the interior of the case 52. A liner 60 is disposed over the explosive material 58. In FIG. 2A, the dotted lines represent channels within the case 52 and openings into the interior of the case 52. FIGS. 2C and 2D are modified sectional views of FIG. 2A. For purposes of clarity, FIGS. 2C and 2D are planar projections of the channels 62-68 and 80, respectively.

Case 52 includes four channels 62, 64, 66, 68 extending from a common opening 70 on the rear end of the case to four diametrically opposed openings 72, 74, 76, 78 in the interior of the case adjacent the explosive material. The common opening 70 on the rear end of the case may be centered on the longitudinal axis X-X. The four openings 72-78 in the interior of the case are circumferentially spaced about 90 degrees apart and are equidistant from the longitudinal axis X-X.

Case 52 further comprises a fifth channel 80 extending from an opening 82 on the rear end of the case to an opening 84 in the interior of the case adjacent the explosive material. The opening 82 on the rear end of the case is a different opening than the common opening 70 for the four channels 62-68. The opening 84 in the interior of the case is centered on the longitudinal axis X-X.

In shaped charges 10 and 50, each set of channels begins at a common initiation point on the rear end of the case and then forms single or multiple detonation paths to the main explosive in the case. The channels in the case may be filled with an explosive or detonation cord. The desired jet output is produced by selecting and initiating only one of the openings in the rear of the case. One way to do this is to place det cord over the selected openings. As used herein, the "rear" or "rear end" of the case is broadly defined as any portion of the case that is to the rear of the open front end. Thus, the "rear" or "rear end" of the case includes side walls that may be angled, horizontal or curved.

In shaped charge 10, det cord placed only on opening 24 produces a conventional axisymmetric jet for deep penetration. Det cord placed only on opening 32 produces a fan-shaped jet. Det cord placed only on opening 42 produces a wider fan-shaped jet, because the interior openings associated with opening 42 are further forward axially than the interior openings associated with opening 32. In shaped charge 50, det cord placed only on opening 82 produces a conventional axisymmetric jet for deep penetration. Det cord placed only on opening 70 produces a cross-shaped or plus sign shaped jet.

Figure 3B:
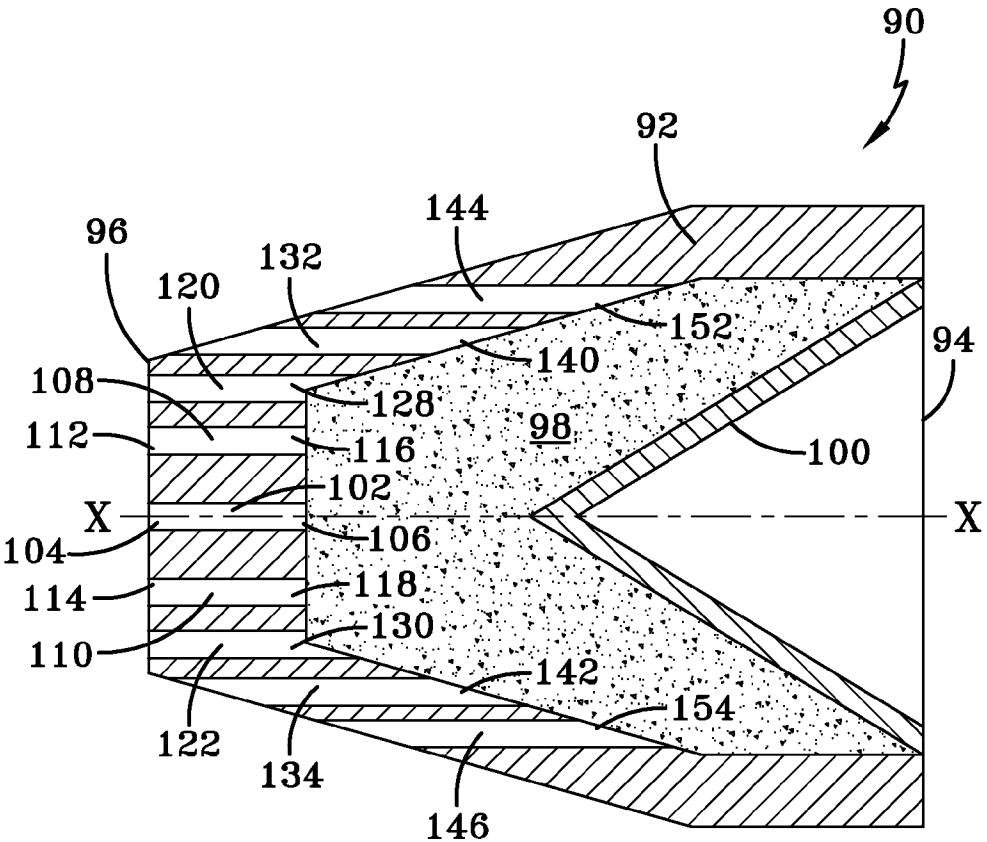
FIG. 3B is a sectional view along the line 3B-3B of FIG. 3A.
Figure 3A:
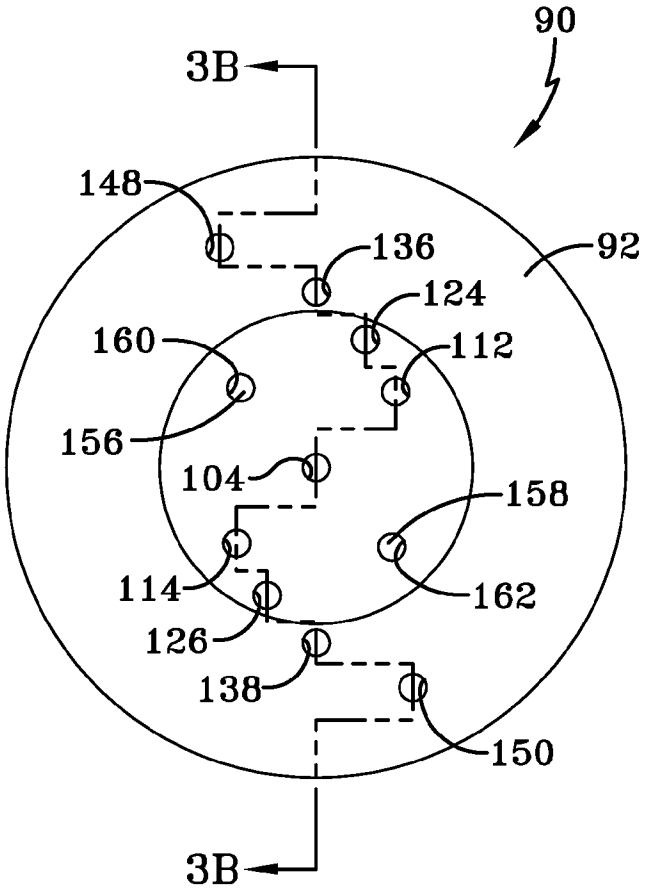
FIG. 3A is a rear view of another embodiment of a shaped charge.

FIG. 3A is a rear view of another embodiment of a shaped charge 90. FIG. 3B is a sectional view along the line 3B-3B of FIG. 3A. Shaped charge 90 comprises a case 92 having an open front end 94, a closed rear end 96, an interior and a longitudinal axis X-X. Explosive material 98 is disposed in the interior of the case 92. A liner 100 is disposed over the explosive material 98.

Case 92 includes a first channel 102 extending from an opening 104 on the rear end of the case 92 along the longitudinal axis X-X to an opening 106 in the interior of the case adjacent the explosive material. A pair of second channels 108, 110 extend from a pair of openings 112, 114 on the rear end of the case to a pair of diametrically opposed openings 116, 118 in the interior of the case adjacent the explosive material. The pair of openings 116, 118 are disposed on opposite sides of the opening 106.

Shaped charge 90 further comprises a pair of third channels 120, 122 extending from a pair of openings 124, 126 on the rear end of the case to a pair of diametrically opposed openings 128, 130 in the interior of the case adjacent the explosive material. The pair of openings 128, 130 are disposed on opposite sides of the opening 106, radially outward from the pair of openings 116, 118 and axially forward of the openings 116, 118.

Additional pairs of channels may be added. Each additional pair of channels ends in diametrically opposed openings in the interior of the case that are radially outward of the preceding pair of interior openings and located axially further forward than the preceding pair of interior openings. For example, a pair of fourth channels 132, 134 extends from a pair of openings 136, 138 on the rear end of the case to a pair of diametrically opposed openings 140, 142 in the interior of the case adjacent the explosive material. Openings 140, 142 are disposed on opposite sides of the opening 106, radially outward from the pair of openings 128, 130 and axially forward of the openings 128, 130.

Similarly, a pair of fifth channels 144, 146 extends from a pair of openings 148, 150 on the rear end of the case to a pair of diametrically opposed openings 152, 154 in the interior of the case adjacent the explosive material. Openings 152, 154 are disposed on opposite sides of the opening 106, radially outward from the openings 140, 142 and axially forward of the openings 140, 142.

A pair of sixth channels 156, 158 (FIG. 3A) extend from a pair of openings 160, 162 on the rear end of the case to a pair of diametrically opposed openings (not shown) in the interior of the case adjacent the explosive material. The interior case openings of channels 156, 158 have about the same radial and axial position as openings 118, 116, respectively, but are offset circumferentially about ninety degrees from the openings 118, 116.

It is the location of the interior openings of the various channels that determine where the explosive 98 will be initiated. Therefore, the precise location of the openings on the rear of the case and the position of the channels is not as important. Preferably, however, for ease of construction, all the channels are substantially parallel to the longitudinal axis X-X with the location of the openings on the rear of the case mirroring the location of the openings in the interior of the case.

In shaped charge 90, each channel begins at an initiation point on the rear and of the case and then forms a single path to the main explosive in the case. The channels may be filled with an explosive or detonation cord. The desired jet output is produced by selecting and initiating certain openings in the rear of the case. One way to do this is to place det cord over the selected openings.

In shaped charge 90, det cord placed on opening 104 produces a conventional axisymmetric jet for deep penetration. Det cord placed on openings 114 and 112 (or 160 and 162) produces a fan-shaped jet. Det cord placed on the four openings 114, 112, 160 and 162 produces a cross-shaped or plus sign shaped jet. Det cord placed on openings 124 and 126 produces a wider fan-shaped jet than openings 114 and 112 (or 160 and 162), because the diametrically opposed interior openings associated with openings 124 and 126 are further forward axially than the diametrically opposed interior openings associated with openings 114 and 112 (or 160 and 162). Likewise, det cord place on openings 136 and 138 produces a wider fan-shaped jet than openings 124 and 126 and det cord placed on openings 148 and 150 produces a wider fan-shaped jet than openings 136 and 138.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A shaped charge, comprising:

a case having an open front end, a closed rear end, an interior and a longitudinal axis;

an explosive material disposed in the interior of the case; and a liner disposed over the explosive material;

wherein the case includes a first channel extending from an opening on the rear end of the case along the longitudinal axis to an opening in the interior of the case adjacent the explosive material; and a pair of second channels, the pair of second channels having a common opening on the rear end of the case, the common opening being a different opening than the opening for the first channel, the pair of second channels ending in a pair of diametrically opposed openings in the interior of the case adjacent the explosive material, the pair of openings being disposed on opposite sides of the opening of the first channel.

2. The shaped charge of claim 1 wherein the pair of openings are about a same distance from the interior case opening for the first channel.

3. The shaped charge of claim 2 wherein the pair of openings and the interior case opening for the first channel are substantially collinear.

4. The shaped charge of claim 1 further comprising a pair of third channels, the pair of third channels having a common opening on the rear end of the case, the common opening for the third channels being a different opening than the opening for the first channel and the common opening for the second channels, the pair of third channels ending in a pair of diametrically opposed openings in the interior of the case adjacent the explosive material, the pair of openings being disposed on opposite sides of the interior case opening of the first channel and further forward than the pair of interior case openings for the second channels.

5. The shaped charge of claim 4 wherein the pair of interior case openings for the third channels are about a same distance from the interior case opening for the first channel.

6. The shaped charge of claim 5 wherein the pair of interior case openings for the third channel and the interior case opening for the first channel are substantially collinear.

7. The shaped charge of claim 6 wherein the pair of interior case openings for the third channel, the pair of interior case openings for the second channels and the interior case opening for the first channel are substantially collinear.

8. A shaped charge, comprising:

a case having an open front end, a closed rear end, an interior and a longitudinal axis;

an explosive material disposed in the interior of the case; and a liner disposed over the explosive material;

wherein the case includes four channels extending from a common opening on the rear end of the case to four diametrically opposed openings in the interior of the case adjacent the explosive material and the common opening of the rear end of the case is centered on the longitudinal axis, and the four common openings in the interior of the case are circumferentially spaced about 90 degrees apart and are equidistant from the longitudinal axis, and the shaped charge further comprises a fifth channel extending from an opening on the rear end of the case to an opening in the interior of the case adjacent the explosive material, the opening on the rear end of the case being a different opening that the common opening of the four channels, the opening in the interior of the case being centered on the longitudinal axis.

9. A method, comprising:

providing the shaped charge of claim 4; and detonating the shaped charge using only one of 1) the opening on the rear end of the case for the first channel; 2) the common opening on the rear end of the case for the second channels; and 3) the common opening on the rear end of the case for the third channels.

10. A method, comprising:

providing the shaped charge of claim 8; and detonating the shaped charge using only one of the common opening on the rear end of the case for the four channels and the opening on the rear end of the case for the fifth channel.

11. A shaped charge, comprising:

a case having an open front end, a closed rear end, an interior and a longitudinal axis;

an explosive material disposed in the interior of the case; and a liner disposed over the explosive material;

wherein the case includes a first channel extending from an opening on the rear end of the case along the longitudinal axis to an interior opening in the interior of the case adjacent the explosive material; and a pair of second channels extending from a pair of openings on the rear end of the case to a pair of diametrically opposed interior openings in the interior of the case adjacent the explosive material, the pair of diametrically opposed interior openings of the second channels being disposed on opposite sides of the first channel.

12. The shaped charge of claim 11 further comprising a pair of third channels extending from a pair of openings on the rear end of the case to a pair of diametrically opposed interior openings in the interior of the case adjacent the explosive material, the pair of diametrically opposed interior openings of the third channels being disposed on opposite sides of the interior opening of the first channel and radially outward from the pair of interior openings of the second channels.

13. The shaped charge of claim 12 further comprising a pair of fourth channels extending from a pair of openings on the rear end of the case to a pair of diametrically opposed interior openings in the interior of the case adjacent the explosive material, the pair of diametrically opposed interior openings of the fourth channels being disposed on opposite sides of the interior opening of the first channel, radially outward from the pair of interior openings of the third channels and axially forward from the pair of interior openings of the third channels.

14. The shaped charge of claim 13 further comprising a pair of fifth channels extending from a pair of openings on the rear end of the case to a pair of diametrically opposed interior openings in the interior of the case adjacent the explosive material, the pair of interior openings for the fifth channels being disposed on opposite sides of the interior opening of the first channel, radially outward from the pair of interior openings of the fourth channels and axially forward from the pair of interior openings of the fourth channels.

15. The shaped charge of claim 14 further comprising a pair of sixth channels extending from a pair of openings on the rear end of the case to a pair of diametrically opposed interior openings in the interior of the case adjacent the explosive material, the pair of interior openings of the sixth channels being disposed on opposite sides of the interior opening of the first channel, offset circumferentially about ninety degrees from the interior openings of the second pair of channels and disposed radially outward from the interior opening of the first channel about a same distance as the interior openings for the second pair of channels.

16. The shaped charge of claim 15 wherein the first, second, third, fourth, fifth and sixth channels are substantially parallel.

17. A method, comprising:

providing the shaped charge of claim 15; and detonating the shaped charge using at least one of the first channel, the pair of second channels, the pair of third channels, the pair of fourth channels, the pair of fifth channels and the pair of sixth channels.

18. The method of claim 17 wherein the detonating step includes using only one of the first channel, the pair of second channels, the pair of third channels, the pair of fourth channels, the pair of fifth channels and the pairs of second and sixth channels.

* * * * *